United States Patent [19]

Kellman et al.

[11] Patent Number: 4,799,688

[45] Date of Patent: Jan. 24, 1989

[54] LIVE FIRE TARGET SYSTEM

[75] Inventors: George A. Kellman, Rochester; Richard E. Flower, Macedon; Harvey L. Kidder, Geneseo, all of N.Y.

[73] Assignee: Eastman Kodak Company, Rochester, N.Y.

[21] Appl. No.: 7,211

[22] Filed: Jan. 27, 1987

[51] Int. Cl.[4] ..... F41J 1/08; F41J 5/00

[52] U.S. Cl. ..... 273/371; 273/373; 273/348.1; 434/16

[58] Field of Search ..... 273/348, 348.1, 371, 273/372, 373, 376; 434/16; 324/58, 5 B, 534, 71.4

[56] References Cited

U.S. PATENT DOCUMENTS

| | | | |
|---|---|---|---|
| 3,580,579 | 5/1971 | Scharz | 273/102.2 A |
| 3,656,056 | 4/1972 | Dalzell, Jr. | 324/65 R |
| 4,260,160 | 4/1981 | Ejnell | 273/408 |
| 4,313,182 | 1/1982 | Knight | 367/117 |
| 4,346,901 | 8/1982 | Booth | 273/408 |
| 4,349,728 | 9/1982 | Phillips | 235/400 |
| 4,357,531 | 11/1982 | Knight | 235/400 |
| 4,405,132 | 9/1983 | Thalmann | 273/348.1 |
| 4,422,646 | 12/1983 | Rosa | 273/348.1 |
| 4,505,481 | 3/1985 | Knight | 273/348.1 |
| 4,521,861 | 6/1985 | Logan | 364/517 |
| 4,605,232 | 8/1986 | Hundstad | 273/348.1 |

OTHER PUBLICATIONS

"TDR for Cable Testing"-Tektronix Application, Note AX-3241-1.

*Primary Examiner*—Leo P. Picard
*Assistant Examiner*—Jessica J. Harrison
*Attorney, Agent, or Firm*—James A. Smith

[57] ABSTRACT

A target system includes a target comprising a plurality of spaced, parallel, electrically conductive strips disposed on a target surface. An electrically conductive backplane is provided on a back surface of the target in a plane parallel to the target surface. The system further includes Time Domain Reflectometry pulse generator connected to the backplane and to one end of each of the conductive strips for generating a pulse on each of the strips. The characteristics of reflected pulse are measured to determine the size and location of any projectile hits through the target. The backplane is energized to provide the target with a thermal silhouette.

28 Claims, 1 Drawing Sheet

LIVE FIRE TARGET SYSTEM

BACKGROUND OF THE INVENTION

The present invention relates generally to targets and more specifically to an electronic target system which detects the size and location of any projectile hits as well as providing a thermal silhouette of a desired shape.

In live fire training environments, target systems preferably provide both visual and thermal target silhouettes for firing upon. These targets are spaced a substantial distance from a user, and, while having indoor applications, are often used for extended periods of time on outdoor ranges. Targert are, by their nature, shot upon and destroyed, and thus require frequent replacement.

It is known in the art to provide a target which presents a visual and thermal silhouette to users. U.S. Pat. No. 4,422,646 to Rosa shows an infrared target wherein a thin layer of carbon is disposed on an insulating film and overlain with a thermally insulating pad. The carbon layer is energized with an electrical current to generate a thermal image. This target system does not, however, provide any information regarding the location or size of projectile hits.

Target systems are also known which indicate the location of projectile hits. U.S. Pat. No. 3,656,056 to Dalzell Jr. shows a target system wherein the target comprises a plurality of adjacent, folded, electrically resistive strips. Electronics are provided for monitoring the resistance of these strips. When a projectile hit short circuits a folded strip, the electronics calculates the hit location and reports the same to a user. U.S. Pat. No. 3,580,579 to Scharz shows a target system wherein a plurality of target elements are mounted one behind the other in relatively inclined planes. Each target element includes two electrically insulated, parallel sheets of electrically conductive material. Electronics are used to monitor the electrically conductive sheets in each element. When a projectile hits the target and short circuits the sheets in a given element, the electronics generate a pulse. The timing between the pulses generated by the plurality of relatively inclined, stacked elements is used to calculate the location of the hit. Both of these systems suffer from the disadvantage that they do not provide any information regarding the size of a projectile hit. Further, neither provides a thermal silhouette.

It would thus be desirable to provide a target system which overcomes the disadvantages of the above-cited patents. Such a system should provide information, in real time and to a remote user, regarding both the location and size of any projectile hits. This system should provide targets which are inexpensive to manufacture, are easily changed, and which are capable of surviving for required periods of time in an outdoor range environment. It would be further desirable if such a target system would provide both a thermal and visual silhouette of a desired target shape.

SUMMARY OF THE INVENTION

A new and improved target system is provided wherein the time propagation characteristics of a reflected pulse are used to provide projectile hit size and location data, in real time, to a remote user. The target system provides economical, sturdy, and easily replaced targets, as well as the ability to optionally generate a thermal image.

A target system constructed in accordance with the present invention includes a dielectric support defining a target surface. At least one electrically conductive strip is disposed on the target surface. Sensing means are connected to the strip for generating an electrical effect so as to detect both the size and location of any projectile hits through the target.

In one embodiment of the present invention, the target system comprises a dielectric support defining mutually parallel target and back surfaces. A plurality of electrically conductive strips are disposed on the target surface in generally parallel, spaced relationship. A conductive backplane is disposed on the back surface. Sensing means, such as a Time Domain Reflectometry pulse generator, are connected to the backplane and at one end of each of the electrically conductive strips. These sensing means generate an electrical pulse on each of the strips, and sense the reflection of the pulse from any hits on the strip or from the terminating end of the strip. Interpretation of these reflected pulses, particularly the time between the generation of the electrical pulse and its reflected pulses, and the amplitude of the reflected pulses, are used to determine the size and location of any hits. Further, the backplane can optionally be energized to provide a thermal silhouette. When the backplane is energized to generate a thermal silhouette, the target is situated with its back surface, and hence the energized backplane, directed at the user.

The conductive strips and backplane are optionally fabricated by an economical vapor deposition process of metal onto film bases, the film bases in turn being disposed on the support. In another embodiment of the invention, separate electrically insulated backplanes can be provided, one for use with the pulse generator, and, one to provide the thermal silhouette.

BRIEF DESCRIPTION OF THE DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawings in which:

DETAILED DESCRIPTION OF THE INVENTION

Figure 1:
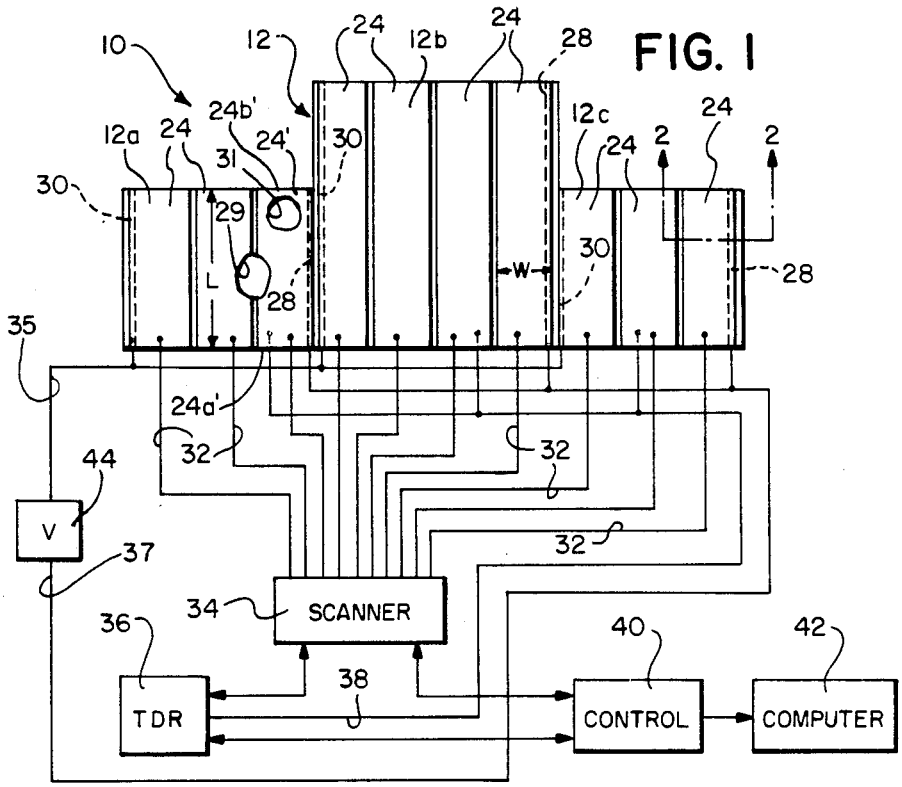
FIG. 1 is a plan view, partially in schematic form, of a target system constructed in accordance with the present invention.
Figure 2:
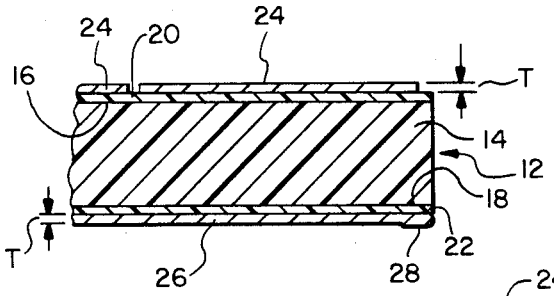
FIG. 2 is a sectional view taken along line 2—2 of FIG. 1.

Referring now to FIGS. 1 and 2, an electronic target system 10 comprises a target 12 including three modules **12*a*, 12*b*, 12*c*, these modules being arranged to present a silhouette selected to mimic that of a real life combat target, such as a tank. Excepting for size and shape, modules 12*a*, 12, and 12c** are constructed identically.

For purposes of explanation, the structure of these modules and hence target 12 will be described with respect to module **12*c*, a sectional view of which is shown in FIG. 2. Target 12 includes a dielectric support 14 defining mutually parallel target and back surfaces 16** and 18, respectively. A thin, flexible, dielectric base 20 overlies target surface 16 of support 14 and is mounted thereon, for example, by a suitable adhesive. Similarly, a thin, flexible, dielectric base 22 is likewise mounted on back surface 18. Disposed on base 20, and hence overlying target surface 16, are a plurality of generally rectangular, spaced, and parallel electrically conductive strips 24. Disposed on base 22, and hence overlying back surface 18 of support 14, is an electrically conductive backplane 26. Proximate opposing lateral edges (as viewed in FIG. 1) of each module 12*a*, 12*b*, and 12*c*, regions of backplane 26 are thickened to form a pair of electrical bus-bars 28, 30 for conducting an electrical current through the backplane. Holes 29 and 31 in module 12*a* indicate "hits", or areas where projectiles have passed through target 12.

Support 14 comprises a stiff, substantially homogeneous, water-resistant, thermal and electrical dielectric material such as a resin-impregnated paper or a plastic. Support 14 is selected to be thick enough to support the weight of target 12, but preferably doesn't exceed about 1.00 inch in thickness. Bases 20, 22 each comprise a thin layer, preferably 4–7 mils thick, of a flexible dielectric material such as the polyethylene terephthalate plastic Estar (Estar is a registered trademark of Eastman Kodak, Co.), a polyimide, or a resin-impregnated paper. Strips 24 and backplane 26 comprise thin layers of conductive material such as carbon or a metal. Suitable, exemplary metals include copper, nickel, or stainless steel. These metals are preferably coated on bases 20, 22 by a fast, economical process of vapor deposition. The thicknesses T of strips 24 and backplane 26 are dependant on the resistivity of the metals chosen, but are generally in the range of from 1,000–2,000 angstroms, with the thickness of bus-bar regions 28, 30 increasing to about 5,000–7,000 angstroms. The width W of conductive strips 24 is selected to be greater than the largest diameter of the projectiles to be fired at target 12. For example, and without limitation, when 10 inch projectiles are to be fired at target 12, strips 24 are preferably chosen to have a width W of 12 inches, and to be spaced about $\frac{1}{4}$–$\frac{1}{2}$ inches apart.

Connected proximate a first, lower (as viewed in FIG. 1) end of each strip 24 via separate conductors 32 is a scanner 34. Scanner 34 comprises, for example, a commercially available, high-frequency multiplexer, or an R.F. switch. Connected at a port of scanner 34, so as to be separately connectable to any selected one of strips 24 through the scanner, is a Time Domain Reflectometry (TDR) pulse generator 36. TDR pulse generator 36 is further connected to backplane 26 of each module 12*a*, 12*b*, and 12*c* via a conductor 38. In this manner, each strip 24, being spaced from backplane 26 as described above, appears as a micro-strip transmission line to TDR pulse generator 36. TDR pulse generator 36 comprises, for example, a Model 1502 or 1503 Cable Tester commercially available from Tektronix, Inc.

A computer controller 40, comprising, for example, a commercially available, digital, mini-computer, is connected to both scanner 34 and TDR pulse generator 36. Controller 40 is in turn connected to a reporting computer 42 which similarly comprises a mini-computer. A voltage source 44 is connected between bus-bars 28, 30 on backplane 26 of each module 12*a*, 12*b*, and 12*c*. It will be understood that, though not shown, some standard means of electrical isolation is preferably provided between voltage source 44 and the remaining electronic components in target system 10. An isolation transformer, for example, would suffice.

In operation, target system 10 functions to indicate the location and size of a projectile hit on target 12, such as those indicated at 29 and 31. To find these random hits, control 40 directs scanner 34 to connect TDR pulse generator 36 with each strip 24 in a predetermined order. For purposes of explanation, the operation of system 10 will be explained as TDR pulse generator 36 pulses the strip indicated at 2' which contains hit 31 and a portion of hit 29. TDR pulse generator 36 generates a high frequency pulse, desirably approaching an impulse, which propagates from connection end 24*a*' along the length L of strip 24'. A portion of that pulse strikes the portion of hit 29 overlapping strip 24', the first irregularity on the strip, and is reflected back to scanner 34 and hence TDR pulse generator 36 and control 40. A record is made of the time interval between the generation of the original pulse, and this first reflected pulse, as well as the amplitude of the reflected pulse. In a similar manner, a portion of the original pulse strikes and is reflected back from hit 31 and from the terminating end 24b' of strip 24'. The times and magnitudes of these later pulses are similarly recorded by the various electronic components. Using analysis techniques well known to those of ordinary skill in the art, the times and magnitudes of the reflected pulses are analyzed to determine the location and size of hits 29 and 31. This analysis can be done in controller 40 or computer 42, and subsequently reported to a user through computer 42. In this manner, the location and size of each hit on target 12 is reported to a remotely located user.

It will be appreciated that the methods of analyzing the pulses generated by TDR pulse generator 36 are well known to those of ordinary skill in the art, and hence are not exhaustively treated here. One reference source describing such analysis methods comprises, for example, Tektronix Application Note AX-3241-1, entitled "TDR FOR CABLE TESTING" and published by Tektronix, Inc. in 1983.

When a thermal silhouette is desired, target 12 is positioned such that back surface 18 and backplane 26 face the user, and voltage source 44 is activated to pass a current through and hence energize the backplane. Energized backplane 26 thus presents a thermal silhouette having the shape of the backplane. It will be understood that backplane 26 is faced at the user to increase the magnitude of the thermal silhouette, and that this positioning of target 12 does not in any way affect the hit detection operation described above. When positioned with backplane 26 facing the users, target 12 offers the further advantage of being visible to both radar and laser sighting systems.

Figure 3:
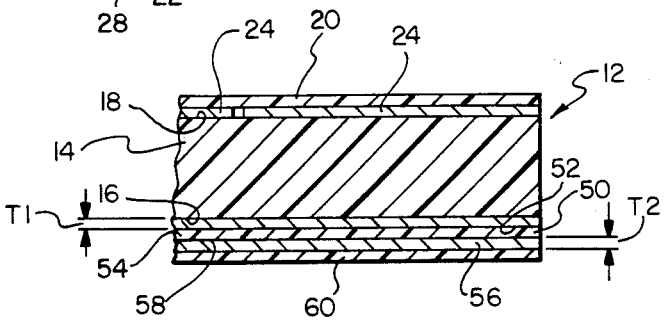
FIG. 3 is a sectional view illustrating an alternate embodiment of the present invention.

Referring now to FIG. 3, an alternate embodiment of the present invention is shown wherein elements identical to those of FIGS. 1 and 2 above retain like indicator numerals. In lieu of single backplane 26 on support 20, the present embodiment employs a first conductive backplane 50 disposed on a first side 52 of a first base 54. A second conductive backplane 56 is disposed on a second side 58 of base 54. A second base 60 overlies backplane 56. Backplanes 50 and 56, and bases 54 and 60, overlay back surface 18 of target 14, with the backplane 50 sandwiched between pulse 54 and the back surface. Bases 54 and 60 comprise the same materials as bases 20 and 22 (FIGS. 1 and 2), and backplanes 50, 56 comprise the same materials as backplane 26 (also FIGS. 1 and 2).

Further changed in this embodiment is the relative positioning of base 20 and strips 24, the strips being sandwiched between the base and target surface 16. Such a structure is preferably formed as described above, i.e. by first forming the strips 24 on base 20, and subsequently disposing the strips and base on target surface 16 using, for example, an appropriate adhesive. The electronic components, not shown in FIG. 3, are identical to those shown in FIG. 1.

In operation, TDR pulse generator 36 is connected to strips 24 and first backplane 50. Voltage source 44 is connected so as to energize second backplane 56. The structure and operation of this embodiment of the invention are in all other respects identical to those described above.

This embodiment of the invention offers an advantage in that, by the nature of the construction of target 12, voltage source 44 is electrically isolated from all other electrical components of target system 10. There is thus no concern regarding isolation, and no requirement for external isolation devices. This embodiment permits the thicknesses T1 and T2 of first and second backplanes 50, 56 respectively, to be separately optimized. Thus, the thickness T1 of first backplane 50 is selected to optimize the operation of of TDR pulse generator 36, while the thickness T2 of second backplane 56 is selected to optimize the resultant thermal image.

A further advantage offered by the embodiment of the invention shown in FIG. 3 is that of greater durability, because all of the metal is covered by a thicker, more durable base layer. That is, strips 24 are covered by base 20, and backplane 54 is covered by base 60. Because no thin metal layers are exposed, they will not be subject to damage caused by weather and abrasion. It will be understood that this sandwiching of metal layers between a base layer and the support could likewise be applied to the embodiment of the invention shown in FIGS. 1 and 2.

It will be appreciated that, while the invention has been described with respect to specific materials, these materials have been chosen for specific characteristics, and that other materials displaying these characteristics may be substituted therefor. Support 14, for example, comprises a thermal and electrical dielectric material, and must provide sufficient stiffness to support target 12. Support 14 is also preferably waterproof for outdoor applications, and substantially homogeneous so as not to interfere with the operation of TDR pulse generator 36. While strips 24, and backplane 26 have been described as being formed on bases 22 and 20, respectively, they may be formed directly on the support. They are preferably formed on the bases to facilitate fabrication, processes being readily available for economically depositing thin metal layers on film bases. Similarly, the materials and thicknesses of the various metal layers are selected to optimize the operation of the TDR pulse generator 36 and the characteristics of the thermal silhouette.

There is thus provided a target system which detects and reports, in real time, hit location and size information to a remote user. The system can further provide a thermal silhouette. The targets used in the system can be inexpensively manufactured, and can survive in outdoor range environments. The use of modules makes the targets light, easy to replace, and facilitates the forming of various silhouette shapes.

While the invention has been particularly shown and described with reference to several preferred embodiments thereof, it will be understood by those skilled in the art that various changes in form and detail may be made therein without departing from the true spirit and scope of the invention defined by the appended claims.

What is claimed is:

1. A target system comprising:

a dielectric support defining mutually parallel target and back surfaces;

a plurality of electrically conductive strips disposed on said target surface in generally parallel, spaced relationship;

a conductive backplane disposed on said back surface;

sensing means connected to said backplane and at one end of each of said electrically conductive strips for applying an electrical pulse on each of said electrically conductive strips and sensing a reflection of said electrical pulse from the end of an electrically conductive strip and from any hits through an electrically conductive strip so as to detect the size and location of a hit on said target.

2. The target system of claim 1 wherein said sensing means determines the time between the initial generation of said electrical pulse and the reflections of said electrical pulse.

3. The target system of claim 2 wherein said sensing means further determines the magnitude of the reflections of said electrical pulse.

4. The target system of claim 1 wherein said strips are patterned on a flexible dielectric base.

5. The target system of claim 1 wherein said backplane is patterned on a flexible dielectric base.

6. The target system of claim 1 and further including a scanner connected between said sensing means and said plurality of conductive strips.

7. The target system of claim 1 wherein said dielectric support comprises a substantially homogeneous material.

8. A target system comprising:

a dielectric support defining mutually parllel target and back surfaces;

a plurality of electrically conductive strips disposed on said target surface in generally parallel, spaced relationship;

a conductive backplane disposed on said back surface;

sensing means connected to said back plane and at one end of each of said electrically conductive strips for applying an electrical pulse on each of said electrically conductive strips and sensing the reflection of said electrical pulse from the end of an electrically conductive strip and from any hits through an electrically conductive strip so as to detect the size and location of a hit on said target; and energizing means connected to said conductive backplane for passing an electrical current through said backplane so as to cause said backplane to generate a thermal image.

9. The target system of claim 8 wherein said energizing means comprises:

a voltage source;

first bus means for connecting a first polarity of said voltage source to a first region of said backplane; and second bus means for connecting a second polarity of said voltage source to a second region of said backplane.

10. The target system of claim 8 wherein said sensing means determines the time between the initial generation of said electrical pulse and the reflections of said electrical pulse.

11. The target system of claim 10 wherein said sensing means further determines the magnitude of the reflections of said electrical pulse.

12. The target system of claim 8 wherein said strips are patterned on a flexible dielectric base.

13. The target system of claim 8 wherein said backplane is patterned on a flexible dielectric base.

14. The target system of claim 8 and further including a scanner connected between said sensing means and said plurality of conductive strips.

15. The target system of claim 8 wherein said dielectric support comprises a substantially homogeneous material.

16. A target system comprising:

a dielectric support defining mutually parallel target and back surfaces;

a plurality of electrically conductive strips disposed on said target surface in generally parallel, spaced relationship;

a dielectric base defining mutually parallel first and second surfaces;

a first conductive backplane disposed on said first surface of said dielectric base;

a second conductive backplane disposed on said second surface of said dielectric base;

said first backplane mounted on said back surface of said dielectric support;

sensing means connected to said first backplane and at one end of each of said electrically conductive strips for applying an electrical pulse on each of said electrically conductive strips and sensing the reflection of said electrical pulse from the end of an electrically conductive strip and from any hits through an electrically conductive strip so as to detect the size and location of a hit on said target; and energizing means connected to said second backplane for passing an electrical current through said second backplane so as to cause said second backplane to generate a thermal image.

17. The target system of claim 16 wherein said energizing means comprises:

a voltage source;

first bus means for connecting a first polarity of said voltage source to a first region of said second backplane; and second bus means for connecting a second polarity of said voltage source to a second region of said second backplane.

18. The target system of claim 16 wherein said sensing means determines the time between the initial generation of said electrical pulse and the reflections of said electrical pulse.

19. The target system of claim 16 wherein said sensing means further determines the magnitude of the reflections of said electrical pulse.

20. The target system of claim 16 wherein said strips are patterned on a flexible dielectric base.

21. The target system of claim 16 and further including a scanner connected between said sensing means and said plurality of conductive strips.

22. The target system of claim 16 wherein said dielectric support comprises a substantially homogeneous material.

23. A target system comprising:

a dielectric support defining a target surface;

at least one electrically conductive strip disposed on said target surface;

sensing means connected to said strip for generating a pulsed electrical effect so as to detect the size and location of any hits through said target.

24. The target system of claim 23 wherein said pulsed electrical effect comprises the applying of an electrical pulse to a first end of said strip and the sensing of reflections of said electrical pulse from the other end of said strip and from any hits through said strip.

25. The target system of claim 24 wherein said sensing means is connected to a first end of said strip for applying said electrical pulse to said strip.

26. The target system of claim 25 wherein said sensing means determines the time between the initial generation of said electrical pulse and the reflections of said electrical pulse.

27. The target system of claim 26 wherein said sensing means further determines the magnitude of the reflections of said electrical pulse.

28. The target system of claim 25 wherein:

said target further defines a back surface parallel to said target surface;

a conductive backplane overlies said back surface; and said sensing means is further connected to said backplane.

* * * * *